United States Patent [19]

Sugiyama

[11] Patent Number: 5,023,581

[45] Date of Patent: Jun. 11, 1991

[54] ELECTROMAGNETIC SWITCH

[75] Inventor: Takeshi Sugiyama, Hyogo, Japan

[73] Assignee: Mitsubishi Denki Kabushiki Kaisha, Tokyo, Japan

[21] Appl. No.: 476,228

[22] Filed: Feb. 7, 1990

[30] Foreign Application Priority Data

Feb. 20, 1989 [JP] Japan ..... 1-19294[U]

[51] Int. Cl.[5] ..... H01H 67/02

[52] U.S. Cl. ..... 335/126; 335/131; 335/132

[58] Field of Search ..... 335/121, 126, 131, 132, 335/270, 273

[56] References Cited

U.S. PATENT DOCUMENTS

| | | | |
|---|---|---|---|
| 4,450,423 | 5/1984 | Morishita | 335/131 |
| 4,677,407 | 6/1987 | Tanaka et al. | 335/202 |
| 4,755,781 | 7/1988 | Bosner | 335/131 |
| 4,779,470 | 10/1988 | Morita et al. | 74/7 |

*Primary Examiner*—George Harris
*Attorney, Agent, or Firm*—Sughrue, Mion, Zinn, Macpeak & Seas

[57] ABSTRACT

An electromagnetic switch for use, for example, in combination with a starter motor for a vehicle, having an appropriate wiping allowance adjusted in assembling the electromagnetic switch. The electromagnetic switch comprises a case, a coil bobbin mounted with a solenoid, a plunger with an integral contact rod axially slidably received in the bore of the coil bobbin, a stationary core fixedly held on the open end of the case so as to limit the range of movement of the plunger, a contact holding member axially slidably mounted on the contact rod of the plunger, a moving contact held on the contact holding member, a stopping means provided at the extremity of the contact rod, a cap joined to the case, and a stationary contact attached to the cap opposite to the moving contact. An elastic packing and a wave spring are inserted between the cap and the stationary core, and the brim of the open end of the case is crimped by rolling so that the cap is held firmly in place on the case and the elastic packing and the wave washer are compressed in a thickness to form an appropriate gap between the movable contact and the stopping means when the plunger is attracted to the stationary core and the movable contact is in contact with the stationary contact.

6 Claims, 4 Drawing Sheets

ELECTROMAGNETIC SWITCH

BACKGROUND OF THE INVENTION

1. Field of the Invention

The present invention relates to an electromagnetic switch and, more particularly, to an electromagnetic switch having a contact shaft with an integral plunger.

2. Description of the Prior Art

Referring to FIG. 5 a conventional electromagnetic switch 1 comprises a tubular outer case 2 with an integral wall 2*a*, and a plunger (moving core) 3 with an integral contact rod 5 received through a central opening formed in the wall 2*a* in the tubular outer case 2. As shown in FIG. 6, a hook 4 is received slidably in the central hole 3*a* of the plunger 3. A moving contact 6 is fixed to a contact holding member 7, which in turn is pressed by a spring 9 against a stopping member 8 attached to the extremity of the contact rod 5. The contact holding member 7 is supported slidably by a stationary core 10 fixedly fitted in the outer case 1. A coil bobbin 12 mounted with a solenoid 11 is fitted in the outer case 2 so as to receive the plunger 3 therein for axial sliding movement. A cap 13 is fixed to the open end of the outer case 2 and defines a contact chamber 14 together with the stationary core 10. A stationary contact 15 is attached to the cap 13 opposite to the moving contact 6. A rubber packing 16 is held between the cap 13 and the stationary core 10 to seal the contact chamber 14.

Referring to FIG. 7 showing the electromagnetic switch 1 as combined with a starter motor for a vehicle, a lever 17 has one end engaging the hook 4 of the plunger 3 and the other end engaging the rear end of an overrunning clutch 18 axially slidably mounted on the output shaft 21 of an electric motor 22. The clockwise swing of the lever 17 is limited by a stop ring 19. A driving pinion 20 is mounted fixedly on the inner race of the overrunning clutch 18.

When the starting switch, not shown, of the vehicle is closed, the solenoid coil 11 of the electromagnetic switch 1 is energized to produce a magnetic field, and the plunger 3 is attracted to the stationary core 10 by the magnetic field as shown in FIG. 7. The attraction of the plunger 3 by the stationary core 10 causes the lever 17 to swing counterclockwise to push the driving pinion 20 to the right, as viewed in FIG. 7. When the plunger 3 is attracted to the stationary core 10, the moving contact 6 comes into contact with the stationary contact 15 to connect the electric motor 22 through the contacts 6 and 15 to a power supply, not shown. When the starter switch is opened to de-energize the solenoid 11, the plunger 3 is released from the stationary core 10 and is returned to its initial position by a return spring.

Incidentally, when the plunger 3 is at the initial position as shown in FIG. 5, the difference $\Delta l = l_1 - l_2$ (wiping allowance), where $l_1$ is the distance between the plunger 3 at the initial position and the stationary core 10, and $l_2$ is the distance between the moving contact 6 and the stationary contact 15, generally is on the order of 1 mm. The wiping allowance $\Delta l$ decreases gradually with time due to the abrasion of the moving contact 6 and the stationary contact 15, and when $\Delta l < 0$, faulty contact occurs. Therefore, the wiping allowance $\Delta l$ must be determined taking into consideration the abrasion of the moving contact 6 and the stationary contact 15. The leverage $k = a_2/a_1$, where $a_1$ is the lever length of one of the arms of the lever engaging the hook 4, and $a_2$ is the lever length of the other arm of the lever 17 engaging the rear end of the overrunning clutch 18, of the lever 17, a play $B_1$ between the lever 17 and the hook 4, and a play $B_2$ between the lever 17 and the stopper ring 19 must meet an inequality: $B_1 + B_2/k > \Delta l$, which is an essential condition for the electromagnetic switch 1. Accordingly, the electromagnetic switch 1 must be fabricated so that the wiping allowance $\Delta l$ meets an inequality: $B_1 + B_2/k > \Delta l > 0$. However, the value of the wiping allowance $\Delta l$ is dependent on the accuracies of a plurality of parts associated with the wiping allowance $\Delta l$, and, in some cases, the wiping allowance $\Delta l$ deviates from the foregoing range owing to the cumulative variation in sizes of the associated parts within the respective tolerances. Accordingly, a plurality of plungers with an integral contact rod differing from each other in size $l_3$ (FIG. 6) are prepared befor fabricating, and one of then is used selectively in fabricating the electromagnetic switch 1 to adjust the wiping allowance $\Delta l$ to an appropriate value.

The conventional electromagnetic switch 1 thus constructed has the following disadvantages.

(1) A plurality of plungers with an integral contact rod having sizes in a range of $l_3 \pm \alpha$ must always be kept in stock.

(2) Several electromagnetic switches produced in the initial stage of a lot production process, in some cases, are rejected as faulty in the wiping allowance $\Delta l$, because the wiping allowance $\Delta l$ is measured in inspecting the electromagnetic switches in the final stage of fabrication after the completion of assembling the electromagnetic switches.

SUMMARY OF THE INVENTION

Accordingly, it is an object of the present invention to provide an electromagnetic switch capable of improving the efficiency and yield of an electromagnetic switch manufacturing process.

To achieve the object of the invention, the present invention provides an electromagnetic switch comprising a bottomed case, a coil bobbin mounted with a solenoid and fitted in the case, a plunger with an integral contact rod axially slidably received in the bore of the coil bobbin, a stationary core fixedly held on the open end of the case so as to limit the range of movement of the plunger, a contact holding member axially slidably mounted on the contact rod of the plunger and supported by the stationary core, a moving contact held on the contact holding member, a stopping member provided at the extremity of the contact rod of the plunger to limit the axial movement of the contact holding member toward the extremity of the contact rod, a cap joined to the open end of the case, and a stationary contact attached to the the cap opposite to the moving contact, characterized in that elastic means is inserted between the stationary core and the cap.

In firmly fastening the cap to the case with the elastic means inserted between the stationary core and the cap, the elastic means is compressed so that the mating surfaces of the stationary core and the cap are spaced apart by a gap of an appropriate size to give an appropriate wiping allowance to the electromagnetic switch.

BRIEF DESCRIPTION OF THE INVENTION

The above and other objects, features and advantages of the present invention will become apparent from the following description taken in conjunction with the accompanying drawings, in which.

DESCRIPTION OF THE PREFERRED EMBODIMENTS

Figure 1:
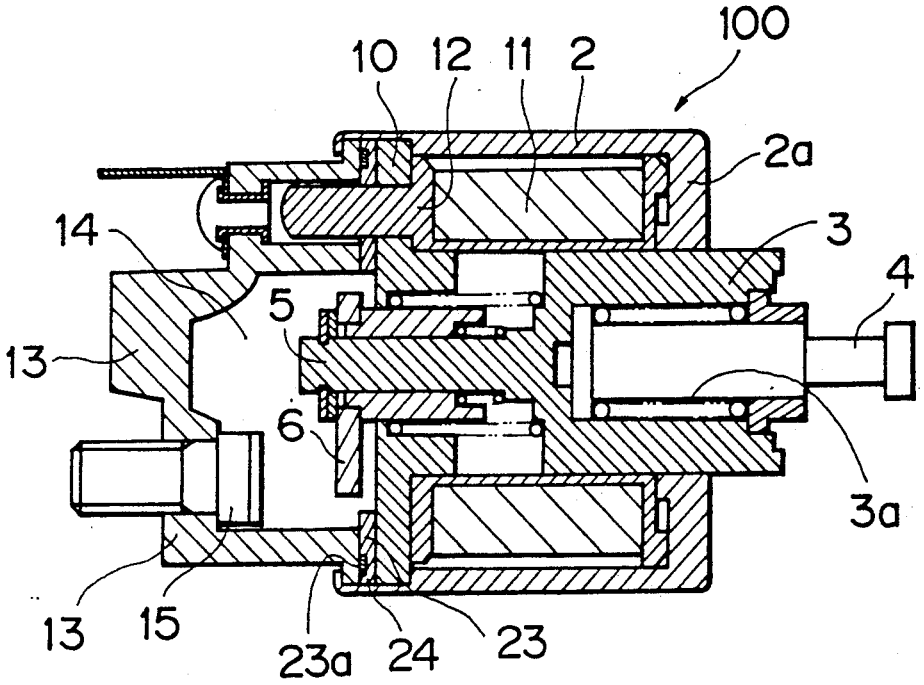
FIG. 1 is a longitudinal sectional view of an electromagnetic switch in a first embodiment according to the present invention.
Figure 2:
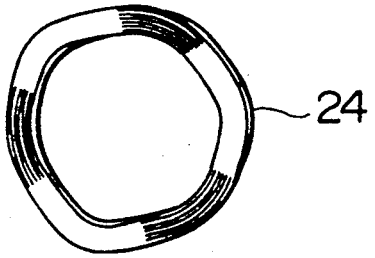
FIG. 2 is a perspective view of a wave washer employed in the electromagnetic switch of FIG. 1.
Figure 5:
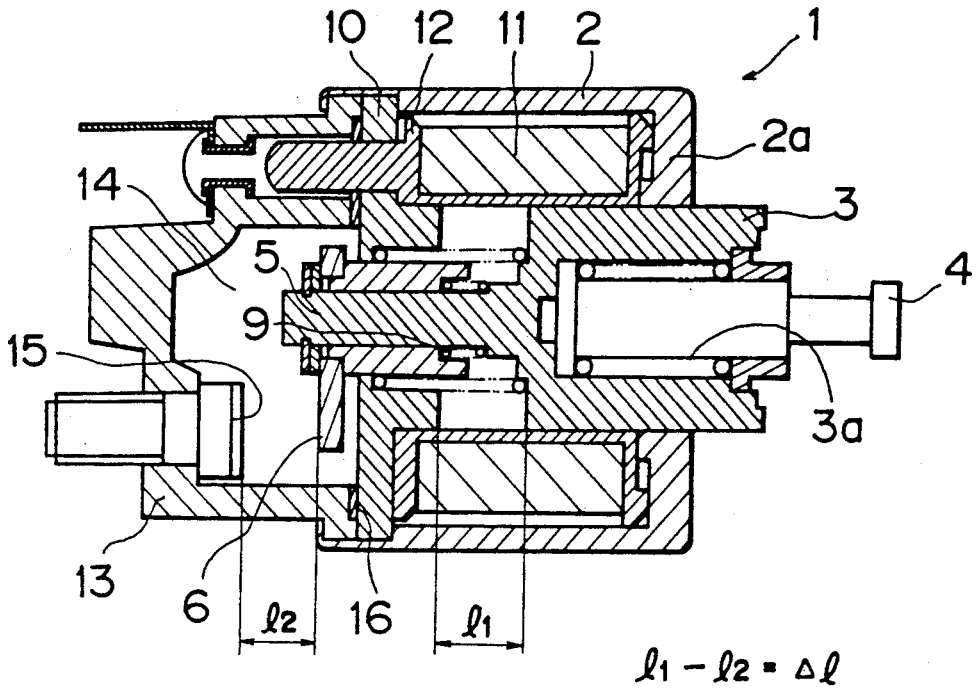
FIG. 5 PRIOR ART
FIG. 5 is a longitudinal sectional view of a conventional electromagnetic switch.
Figure 6:
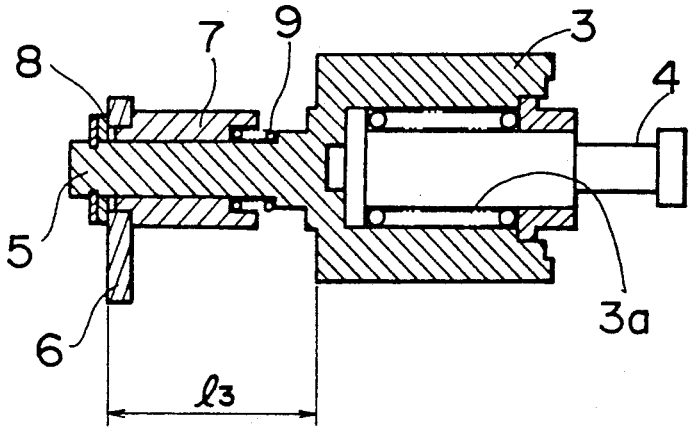
FIG. 6 is a longitudinal sectional view of a plunger and associated parts included in the electromagnetic switch of FIG. 5.
Figure 7:
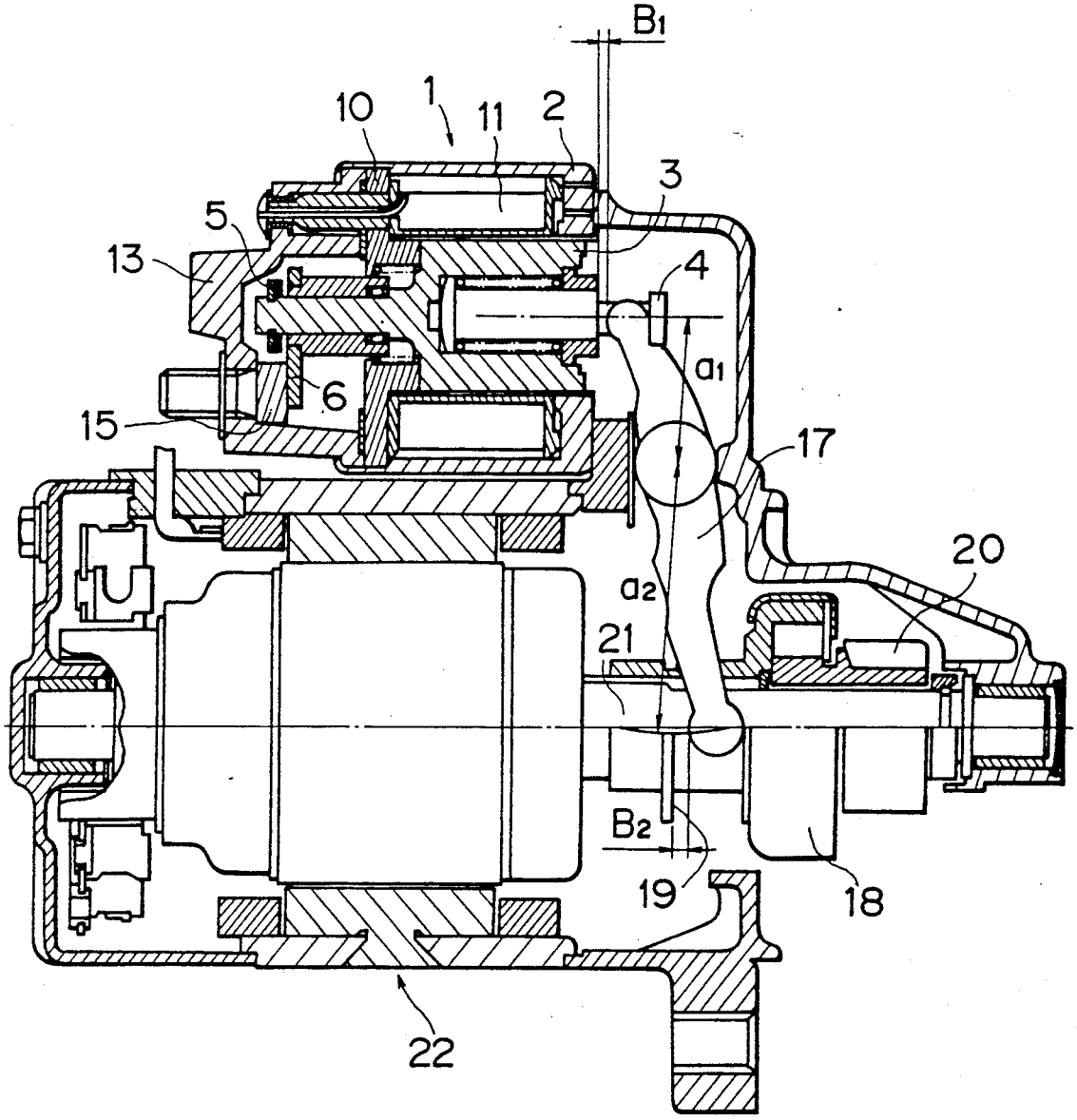
FIG. 7 PRIOR ART
FIG. 7 is a longitudinal sectional view of the electromagnetic switch of FIG. 5 as combined with a starter motor for a vehicle.

Referring to FIG. 1, an electromagnetic switch 100 is provided with a rubber packing 23 inserted between a stationary core 10 and a cap 13. A resilient metallic wave washer 24 as shown in FIG. 2 is placed in an annular recess 23*a* formed in a surface of the packing 23 facing the cap 13. The rest of the components and arrangement of those components of the electromagnetic switch 100 are the same as those of the conventional electromagnetic switch previously described with reference to FIGS. 5 to 7, and hence these components of the electromagnetic switch 100 of the present invention like or corresponding to those of the conventional electromagnetic switch will be denoted by the same reference characters and the description thereof will be omitted to avoid duplication.

Figure 3:
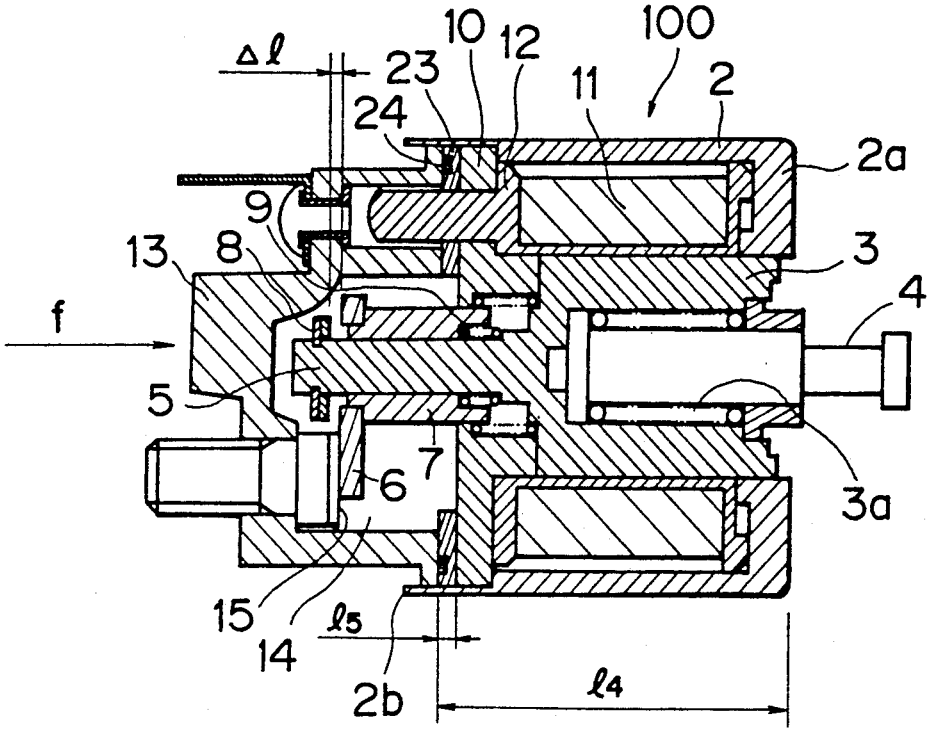
FIG. 3 is a longitudinal sectional view of the electromagnetic switch of FIG. 1 for reference in explaining a procedure of assembling the electromagnetic switch of FIG. 1.

Referring to FIG. 3, in assembling the electromagnetic switch 100, first the coil bobbin 12 mounted with a solenoid 11 is fitted in the case 2 so as to be seated on the bottom wall 2*a* of the case 2, the stationary core 10 is put into the case 2 contiguously with the outer end of the coil bobbin 12, and then the plunger 3 with an integral contact rod 5 is inserted into the case 2 through the central opening of the bottom wall 2*a* of the case 2 and through the bore of the coil bobbin 12 so that the contact rod extends through the stationary core 10 and the shoulder of the plunger 3 is in contact with the inner surface of the stationary core 10 (the distance $l_1=0$) as shown in FIG. 3. Then, the packing 23 is placed on the outer surface of the stationary core 10, the wave washer 24 is placed in the annular recess 23*a* of the packing 23, and then the cap 13 is put on the case 2 so as to cover the stationary core 10. Then, the cap 13 is pressed toward the stationary core 10 by a force f to compress the packing 23 and the wave washer 24 in a total thickness $l_5$ of an appropriate value so that the stationary contact 15 is located opposite to the moving contact 6 with a distance (wiping allowance) $\Delta l$ of an appropriate value between the moving contact 6 and the stopping member 8 attached to the extremity of the contact rod 5; that is, the distance $\Delta l$ between the moving contact 6 and the stopping member 8 is adjusted through the adjustment of the distance $l_4$ between the outer surface of the wall 2*a* and the inner end surface of the cap 13. Then, the brim 2*b* of the open end of the case 2 is crimped by rolling to fasten the cap 13 in place. As is obvious from FIG. 3, the distance $\Delta l$ is equal to the difference between the distances $l_1$ and $l_2$ indicated In FIG. 5.

Thus the distance $\Delta l$ of the electromagnetic switch 100 can be adjusted to an appropriate value by compressing the elastic packing 23 and the wave washer 24 in a desired total thickness. Accordingly, a plurality of plungers differing from each other in the size $l_3$, which must be kept in stock for manufacturing the conventional electromagnetic switch, need not be kept in stock, and no unacceptable electromagnetic switch is produced in the initial stage of lot production. Since the packing 23 is used in combination with the wave washer 24, the resilience of the wave washer 24 keeps rolling force required for crimping the brim 2*b* of the case 2 substantially constant regardless of the variation of the total thickness $l_5$ of the elastic packing 23 and the wave washer 24 with the force f applied to the cap 13 in assembling the cap 13 and the case 2, and prevents faultily fastening the cap 13 to the case 2 even if the total thickness $l_5$ is comparatively large.

Figure 4:
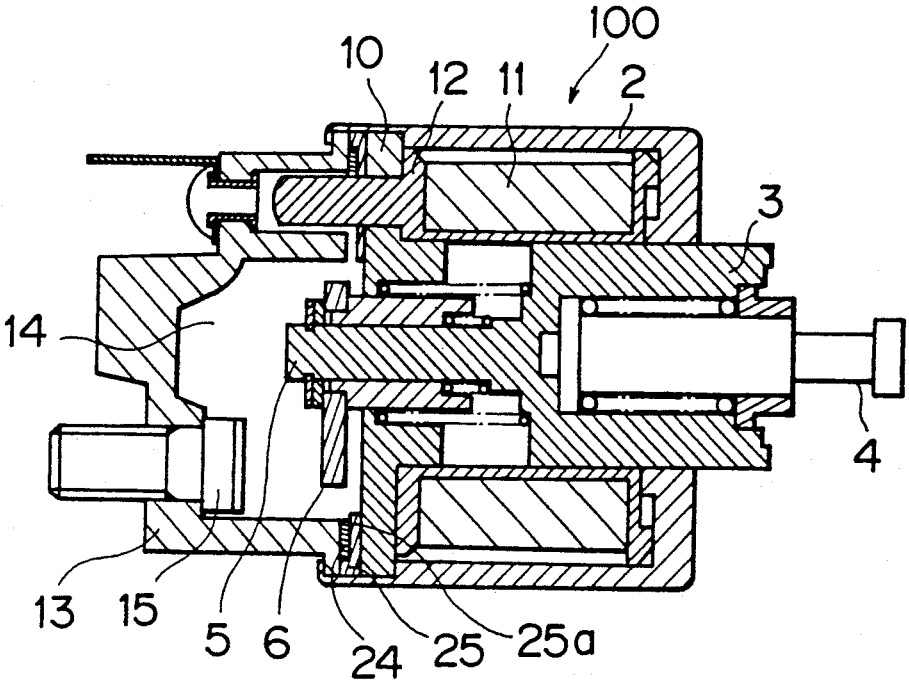
FIG. 4 is a longitudinal sectional view of an electromagnetic switch in a second embodiment according to the present invention.

A packing 25 as shown in FIG. 4 may be employed instead of the packing 23 having the annular recess 23*a* for receiving the wave washer 24. As shown in FIG. 4, the packing 25 has an annular, thin bottom wall 25*a* and a ring-shaped rim standing upright from the periphery of the thin bottom wall 25*a*. The wave washer 24 is seated on the thin bottom wall 25*a*. The sealing effect of the packing 25 is the same as that of the foregoing packing 23, and the effect of the wave washer 24 used in combination with the packing 25 on keeping the rolling force constant is the same as that of the wave washer 24 used in combination with the foregoing packing 23.

The combination of the metallic wave washer 24 and the elastic packing 23 or 25, inserted between the cap 13 and the stationary core 10 may be substituted by any suitable means capable of sealing the gap between the cap 13 and the stationary core 10 and capable of being compressed elastically between the cap 13 and the stationary core 10 so as to exert a predetermined pressure to the cap 13 so that the cap 13 is held firmly in place when the brim 2*b* of the case 2 is crimped by rolling; for example, a rubber ring having a high hardness may be used instead of the wave washer 24, and an integral, elastic member may be used instead of the combination of the wave washer 24 and the packing 23 or 25.

As is obvious from the foregoing description, the wiping allowance of the electromagnetic switch of the present invention is adjusted to an appropriate value by properly compressing the elastic members inserted between the stationary core and the cap in an appropriate total thickness. Accordingly, a plurality of plungers differing from each other in size need not be kept in stock, no unacceptable electromagnetic switch is produced, the efficiency and yield of the production line for producing the electromagnetic switch are improved.

Although the invention has been described in its preferred form with a certain degree of particularity, obviously many changes and variations are possible therein. It is therefore to be understood that the present invention may be practiced otherwise than specifically described herein without departing from the scope and spirit thereof.

What is claimed is:

1. An electromagnetic switch comprising:

a bottomed case;

a coil bobbin mounted with a solenoid and fitted in the case;

a plunger with an integral contact rod axially slidably received in the bore of the coil bobbin;

a stationary core fixedly held on the open end of the case so as to limit the range of movement of the plunger;

a contact holding member axially slidably mounted on the contact rod of the plunger and supported by the stationary core;

a moving contact held on the contact holding member;

a stopping member provided at the extremity of the contact rod of the plunger to limit the axial movement of the contact holding member toward the extremity of the contact rod;

a cap joined to the open end of case; and a stationary contact attached to the cap opposite to the moving contact;

characterized in that elastic means is inserted between the cap and the stationary core to seal the gap between the cap and the stationary core and to exert a pressure to the cap, and the brim of the open end of the case is crimped by rolling in attaching the cap to the case so that the cap is held firmly in place on the case and the elastic means is compressed in a thickness to form an appropriate gap between the movable contact and the stopping means when the plunger is attracted to the stationary core and the movable contact is in contact with the stationary contact.

2. An electromagnetic switch according to claim 1, wherein said elastic means is a combination of an elastic packing placed contiguously with the stationary core and provided with a recess in the surface thereof facing the cap, and a wave washer placed in the recess of the elastic packing.

3. An electromagnetic switch according to claim 2, wherein said wave washer is formed of a metal.

4. An electromagnetic switch according to claim 1, wherein said elastic means is a combination of an elastic packing placed contiguously with the stationary core and provided with a recess in the surface thereof facing the cap, and an elastic ring placed in the recess of the elastic packing.

5. An electromagnetic switch according to claim 4, wherein said elastic ring is formed of a rubber having a high hardness.

6. An electromagnetic switch according to claim 1, wherein said elastic means is an integral elastic member capable of sealing the gap between the cap and the stationary core, and capable of being compressed to exert a pressure to the cap.

* * * * *